US005582503A

United States Patent [19]

Sandoval

[11] Patent Number: 5,582,503

[45] Date of Patent: Dec. 10, 1996

[54] BOTTLED WATER TRANSFER DEVICE

[76] Inventor: Alfredo R. Sandoval, 4712 N. Paseo De Los Cerritos, Tucson, Ariz. 85745

[21] Appl. No.: 628,476

[22] Filed: Apr. 5, 1996

[51] Int. Cl.[6] ..... B66F 9/065

[52] U.S. Cl. ..... 414/738; 141/391; 222/81; 414/412; 414/420; 414/779; 414/783

[58] Field of Search ..... 141/364, 391; 222/81, 83; 414/412, 419, 420, 421, 732, 738, 766, 778, 779, 783; 254/126

[56] References Cited

U.S. PATENT DOCUMENTS

| | | | |
|---|---|---|---|
| 2,414,774 | 1/1947 | Spinks | 414/420 X |
| 4,036,382 | 7/1977 | Perry et al. . | |
| 4,213,727 | 7/1980 | Lighthipe, Jr. | 414/420 |
| 4,846,236 | 7/1989 | Deruntz | 222/81 X |
| 5,127,618 | 7/1992 | Page et al. | 222/81 X |
| 5,280,764 | 1/1994 | Levinrad | 222/81 X |
| 5,288,200 | 2/1994 | Burgers et al. | 414/758 |
| 5,379,814 | 1/1995 | Posly | 414/420 X |
| 5,406,996 | 4/1995 | Wagner et al. | 141/364 |
| 5,425,614 | 6/1995 | Perussi et al. | 414/422 |

*Primary Examiner*—David A. Bucci
*Assistant Examiner*—Janice L. Krizek
*Attorney, Agent, or Firm*—Cahill, Sutton & Thomas P.L.C.

[57] ABSTRACT

A hand cart is adapted to lift an upright water bottle from a support surface of a first height, carry the bottle to a water dispenser of a second height, invert the bottle, and lower a mouth of the bottle into a receiving opening of the dispenser. A scissors/jackscrew mechanism pivotally connected between a pivot arm structure and an upright structure raises and lowers an outer portion of the pivot arm structure. A bottle holding mechanism pivotally connected to the outer portion of the pivot arm structure inverts the bottle. The bottle holding mechanism includes first and second bottle engaging pads pivotally connected to spaced first and second outer portions of the pivot arm structure, respectively, and engaging opposite sides of the bottle between circumferential ridges thereof. Velcro straps secure the bottle to the pads.

9 Claims, 2 Drawing Sheets

BOTTLED WATER TRANSFER DEVICE

BACKGROUND OF THE INVENTION

The invention relates to devices and methods for placing five gallon water bottles on dispensers or coolers to avoid manual lifting of the bottles and spillage of water therefrom.

Consumers frequently purchase pure drinking water delivered to their residences in five gallon water bottles. Such a five gallon bottle of water weighs 42 pounds. Delivery of drinking water in this manner is a large industry in the United States and elsewhere. The delivery person frequently removes a sealed cap from the mouth of a first full bottle and inverts it, and lowers it onto a receiving opening or well of a water cooler or dispenser. The delivery person frequently places additional full bottles in a location specified by the consumer. When the first bottle is empty, the consumer then must remove the sealed cap from a full bottle, lift and carry it to the dispenser, invert the bottle, and lower it onto the dispenser. This can present a major physical challenge to some consumers, especially older or handicapped consumers, and can cause back injuries and other injuries. Furthermore, inverting a full bottle with the cap removed often involves spillage and waste of water.

In recognition of the above difficulties, numerous devices have been proposed to lift full water bottles, carry them to a dispenser/cooler, invert the bottles, and lower them onto the cooler, so as to avoid injury to the user. U.S. Pat. Nos. 5,425,614; 5,406,996; 5,288,200, and 4,036,382 are indicative of the state of the art. However, all of the above devices disclosed in these references are unduly complex and costly.

There is an unmet need for a simple, inexpensive device and technique that is particularly adapted to lifting large water bottles, carrying them to a water dispenser, cooler or the like, inverting them, and lowering them onto a water dispensing device without undue risk of strain or injury to the user and without needless spillage of water.

SUMMARY OF THE INVENTION

Accordingly, it is an object of the invention to provide a simple, inexpensive device and technique for moving a large water bottle from a storage location and placing it on a water dispenser without undue risk of strain or injury to a user.

It is another object of the invention to provide an inexpensive device and technique for moving a heavy water bottle from a storage location and placing it on a water dispensing device without spillage of water.

Briefly described, and in accordance with one embodiment thereof, the invention provides a hand cart adapted to lift an upright water bottle from a support surface of a first height, carry the bottle to a water dispenser of a second height, invert the bottle, and lower a mouth of the bottle into a receiving opening of the dispenser. The hand cart includes a base and a plurality of wheels attached to support and transport the base. An upright structure is supported on the base. A handle attached to the upright structure aids pushing/pulling the cart. A pivot arm structure is pivotally connected to an upper portion of the upright structure. A scissors/jackscrew mechanism is pivotally connected between the pivot arm structure and a lower portion of the upright structure to raise and lower an outer portion of the pivot arm structure. A bottle holding mechanism is pivotally connected to the outer portion of the pivot arm structure and is adapted to rotate to invert a bottle held thereby. In the described embodiment, the scissors/jackscrew mechanism raises the upright bottle in the bottle holding mechanism slightly above the support surface and lowers the inverted bottle onto the dispenser. The scissors/jackscrew mechanism includes a first scissors member pivotally connected at a lower end to the upright structure and pivotally connected at an upper end to a first jackscrew bearing through which the jackscrew extends, a second scissors member pivotally connected at a lower end of the first jackscrew bearing and at an upper end to the pivot arm structure, a third scissors arm pivotally connected at a lower end to the upright structure and at an upper end to a second jackscrew nut, and a fourth scissors member pivotally connected at a lower end to the second jackscrew nut and at an upper end to the pivot arm structure. The bottle holding mechanism includes first and second bottle engaging pads pivotally connected to spaced first and second outer portions of the pivot arm structure, respectively, and engaging opposite sides of the bottle between circumferential ridges thereof. First and second velcro straps are connected to first sides of the first and second bottle engaging pads, respectively, extending partially around a first side of the bottle, and locking together to form a first retaining strap securing the first side of the bottle. Third and fourth velcro straps are connected to second sides of the first and second bottle engaging pads, respectively, extending partially around a second side of the bottle, and locking together to form a second retaining strap securing the second side of the bottle.

DETAILED DESCRIPTION OF THE PREFERRED EMBODIMENTS

Figure 1:
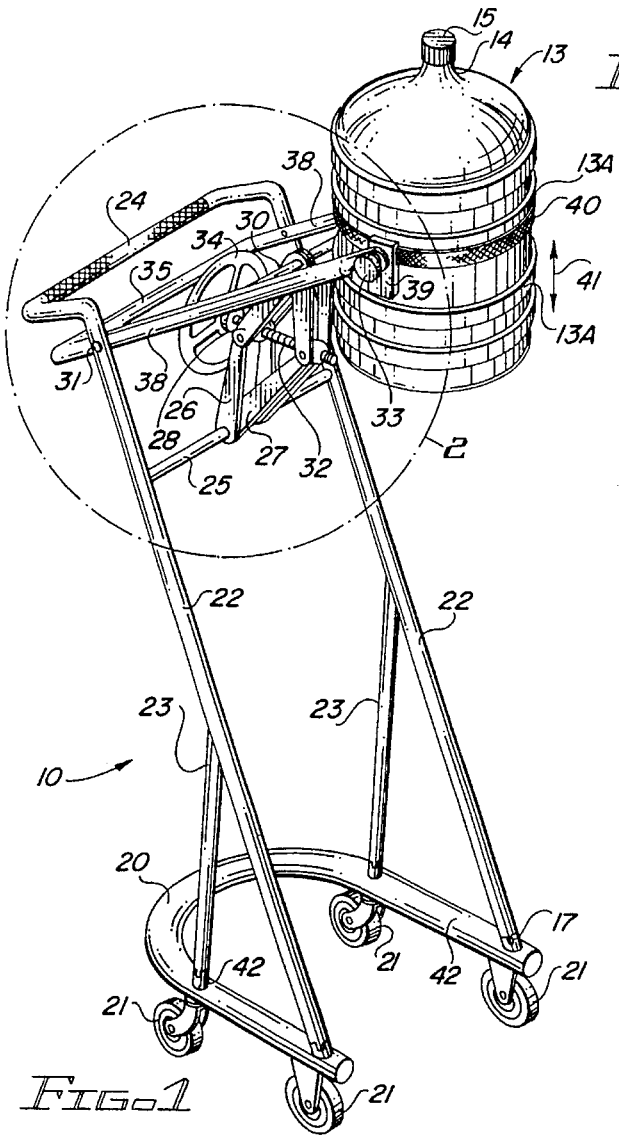
FIG. 1 is a perspective view illustrating a carrier operable to lift a large water bottle from a storage stand, transport the bottle to a water dispenser, invert the bottle, and lower it onto the water dispenser.
Figure 3:
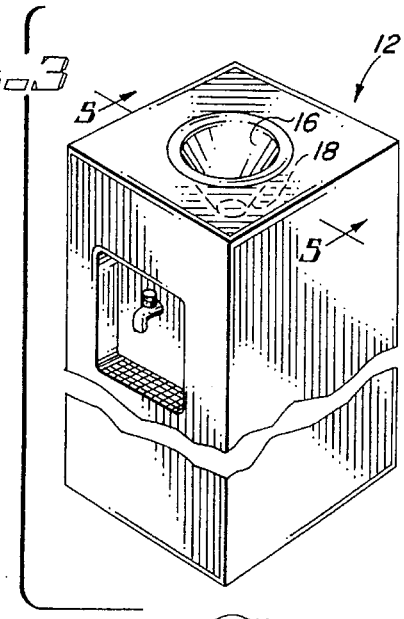
FIG. 3 is a partial perspective view of a dispensing mechanism onto which the water bottle shown in FIG. 1 is to be placed.
Figure 4:
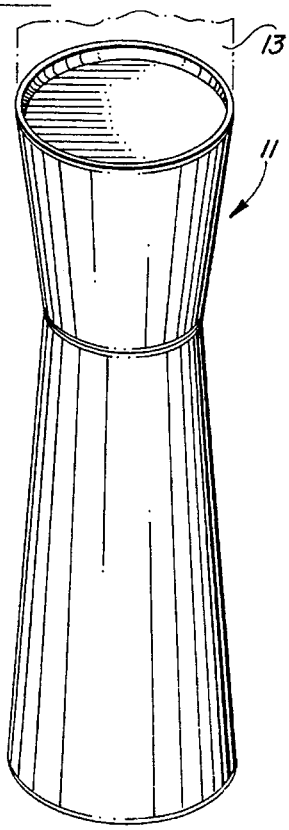
FIG. 4 is a perspective view of a stand from which an upright water bottle can be lifted, inverted, and placed on the dispensing device of FIG. 3.

Referring to FIGS. 1–4, one or more five gallon water bottles 13 initially are placed by a delivery person upright on a suitable shelf or stand 11, the height of which might be approximately 41 inches high. A hand cart 10 is used to lift a water bottle 13 off of a stand (or shelf) 11, transport bottle 13 to a water cooler or dispenser 12, invert bottle 13, and lower its spout 14 into a bowl-shaped cap-puncturing device 16 positioned in a receiving well opening on the top of water cooler 12. The height of the top of water cooler 12 may be approximately 38.5 inches. Preferably, a sealed plastic cap 15 on the mouth of water bottle 13 remains sealed. A sharp puncture element 18 of cap-puncturing element 16 penetrates the plastic cap 15 on the spout 14 of bottle 13 so that water from bottle 13 fills the reservoir in water cooler 12 in the usual manner.

Hand cart 10 includes a U-shaped tubular base 20, preferably of aluminum or steel. Four casters 21 are attached to the bottom of U-shaped base 20, as shown. The front casters at the free ends of U-shaped base 20 are pivotal, and the rear casters are non-pivotal to allow convenient steering of hand cart 10. Alternatively, all four casters can be pivotal.

Two inclined aluminum or steel tubing uprights 22 are attached by a pair of conventional brackets 17 to the free front ends, respectively, of U-shaped base 20. Slanted uprights 22 are approximately 46.5 inches long. The upper ends of slanted uprights 22 are bent to extend rearward several inches, and are bent at a 60 degree angle to form a horizontal handle 24 by means of which the user pushes hand cart 10.

Two vertical braces 23, preferably of aluminum or steel tubing, are attached by conventional brackets 42 to the U-shaped base as shown at their lower ends. The upper ends of braces 23 are connected to support slanted uprights 22 as shown.

A pair of aluminum or steel tubing pivotal support arms 38 are pivotally connected between the upper portions of slanted uprights 22. Pivotal support arms 38 are continuous with, and preferably are integral with a horizontal crossbar 35. Pivot points 31 are made up of bolts and teflon washers. Another horizontal crossbar 30 extends between mid-portions of pivotal support arms 38. A crossbar 24 extends between slanted uprights 22 as shown.

A scissors mechanism is connected between crossbars 25 and 30 to control the elevation of the outer ends of pivot arms 38.

Figure 8:
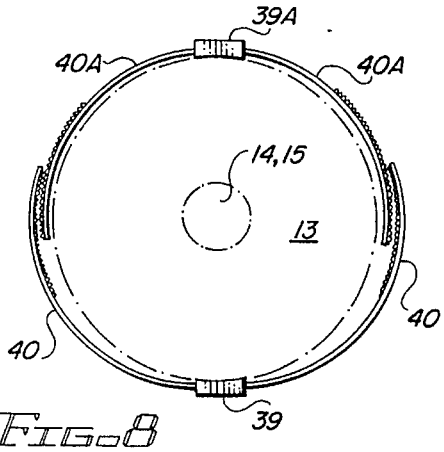
FIG. 8 is a partial section view illustrating the configuration of the velcro closures shown in FIG. 2.
Figure 9:
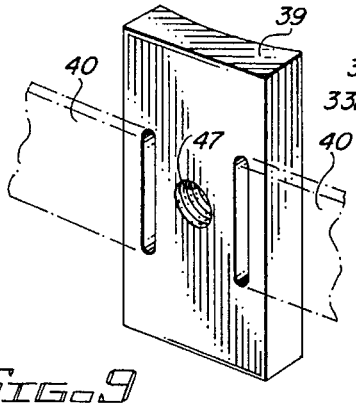
FIG. 9 is a perspective view of the holding pads shown in FIG. 2.
Figure 10:
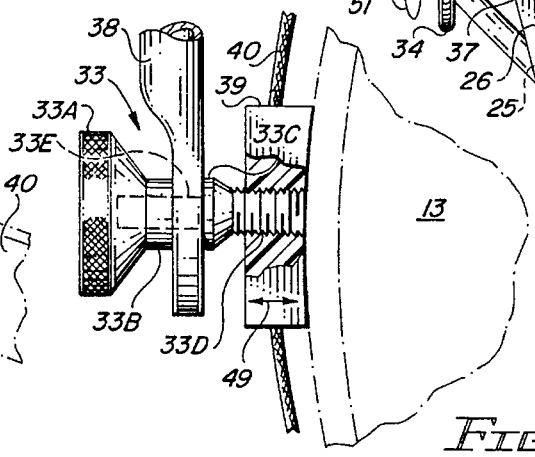
FIG. 10 is a partial section view illustrating adjustment of the holding pads in the device shown in FIG. 2.

A pair of bottle support pads 39 and 39A are pivotally connected to the outer ends of each of pivot arms 38, respectively, as also shown in FIGS. 8–10. One end of each of velcro straps 40 is connected to support pad 39 and one end of each of velcro straps 40A is connected to support pad 39A as shown in FIG. 8 to secure water bottle 13 to prevent forward or rearward movement thereof relative to support pads 39 and 39A. FIG. 8 shows how the inner surface of velcro straps 40 overlap and engage the outer surface of velcro straps 40A, to thereby secure water bottle 13 as shown in FIGS. 1 and 2.

An adjusting mechanism 33 (FIGS. 2 and 10) is provided on the outer end of each pivot arm 38 to adjust the pressure of support pads 39 and 39A against the wall of water bottle 13 between a pair of circumferential ridges 13A (FIG. 2) thereof. Adjusting mechanism 33 includes a handle 33A with an integral cylindrical mid-portion 33B disposed on the left side of pivot arm 38 as shown in FIG. 10. Adjusting mechanism 33 also includes a shoulder 33C and an integral threaded shaft 33D that extends to the right and engages a threaded hole 47 (FIG. 9) in support pad 39. A threaded shaft 33E extends through a clearance hole in the center end portion of pivot arm 38 and engages a matching threaded hole in mid-portion 33B and handle 33A. When handle 33A is rotated, threaded shaft 33D also rotates, causing support pad 39 to move right or left as indicated by arrows 49.

Figure 2:
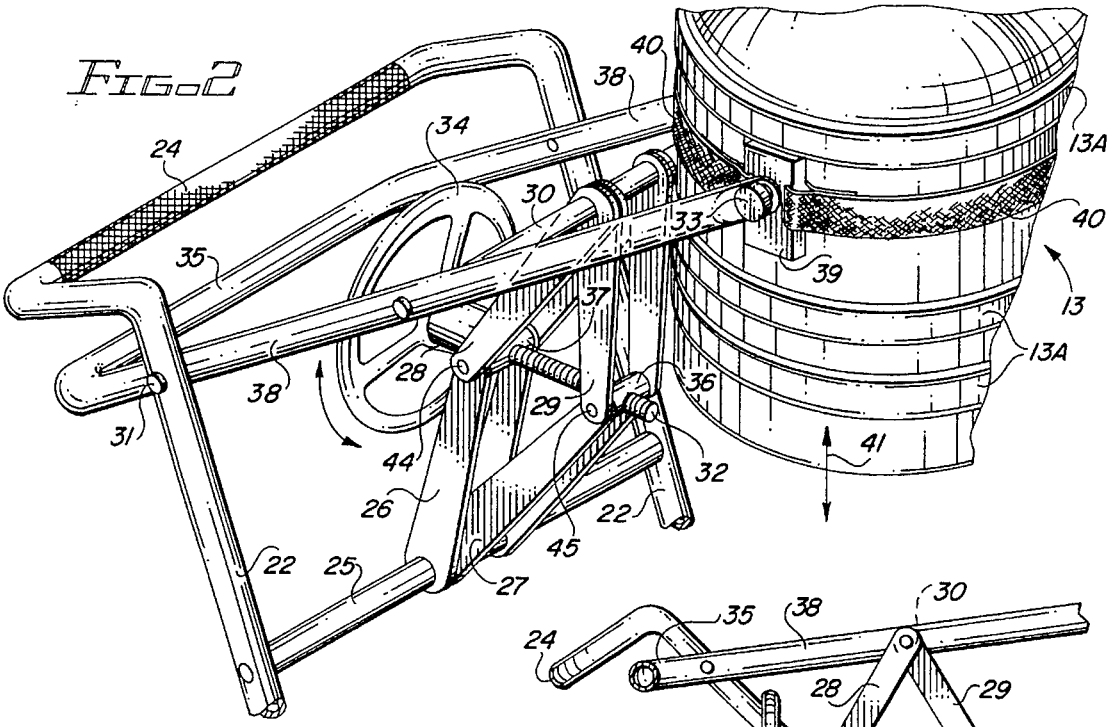
FIG. 2 is a partial perspective enlarged detail of the mechanism shown in FIG. 1.
Figure 7A:
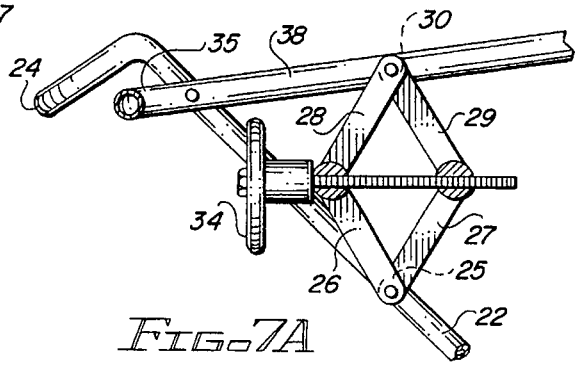
FIGS. 7A and 7B are partial section views useful in illustrating operation of the device of FIG. 1.
Figure 7B:
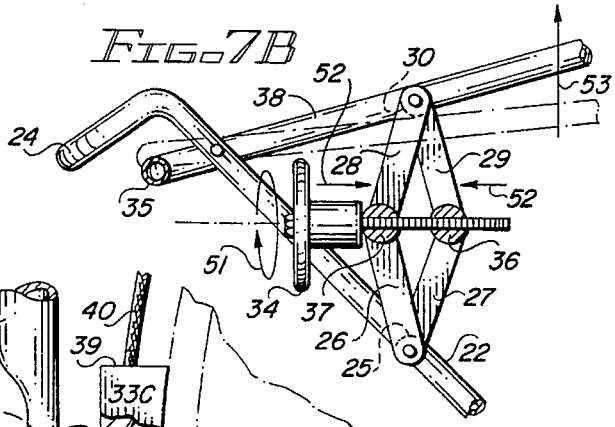

The above mentioned scissors mechanism, best seen in FIGS. 2, 7A and 7B, includes two lower rear members 26 pivotally connected by crossbar 25 at their lower ends to slanted uprights 22. Members 26 are pivotally connected at their upper ends by two pins 44, respectively, to a rear jackscrew bearing 37. The scissors mechanism also includes a pair of lower front members 27 pivotally connected to crossbar 25 at their lower ends. Members 27 are pivotally connected at their upper ends by pins 45, respectively, to a front jackscrew nut 36. A wheel or handle 34 is attached to the rear end of jackscrew 32 which extends through a non-threaded hole of rear jackscrew bearing 37 and a U-threaded front jackscrew nut 36. A pair of rear upper members 28 are pivotally connected to crossbar 30, and hence to the midpoints of pivot arms 38. Members 28 are pivotally connected at their lower ends to pins 44 of rear jackscrew bearing 37. A pair of upper front members 29 are each pivotally connected to crossbar 30, and hence to the midpoints of pivot arms 38, at their upper ends. Members 29 are pivotally connected at their lower ends to pins 45 of front jackscrew nut 36.

Wheel 34 is attached to the left end of jackscrew 32, for example, by threading wheel 34 onto the left end of jackscrew 32 and then locking wheel 34 in place on jackscrew 32 by means of a threaded jam nut. The inner surface of the hub of wheel 34 abuts rear jackscrew bearing 37. Therefore, rotation of wheel 34 as indicated by arrow 51 in FIG. 7B causes jackscrew 32 to rotate in jackscrew nut 36 and jackscrew bearing 37, pulling them together as indicated by arrows 52. This raises the midpoints of pivot arms 38, raising the outer end portions thereof as indicated by arrow 53, and thereby lifting support pads 39 and hence bottle 13.

Figure 5:
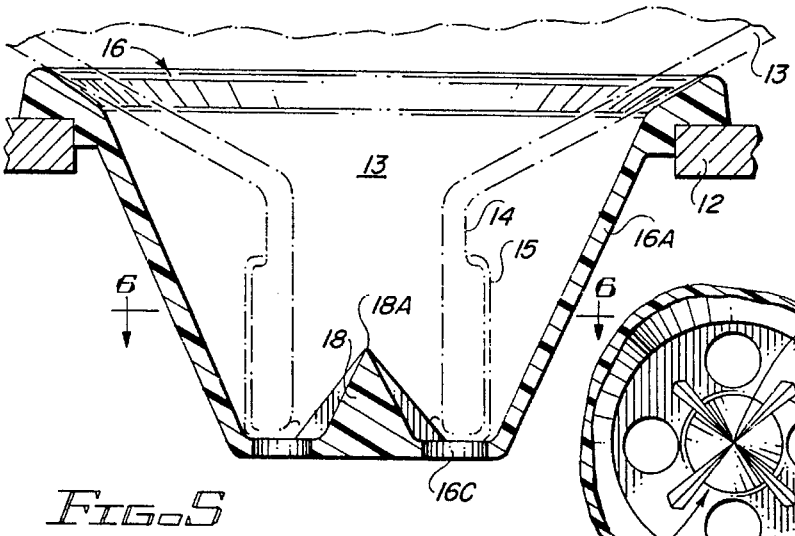
FIG. 5 is a diagram of a mechanism for penetrating a sealed cap of the water bottle as it is lowered onto the stand, to avoid the necessity for removing the cap.
Figure 6:
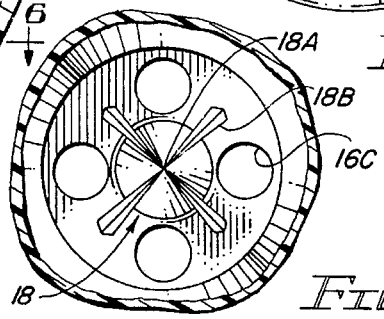
FIG. 6 is a partial section view along section line 6—6 of FIG. 5.

FIGS. 5 and 6 show the details of the cap penetrating device 16, which fits into the reservoir opening of water cooler 12. Cap penetrating device 16 includes a bowl-shaped lower portion 16A with an upper shoulder that rests on the upper surface of water cooler 12. The bowl-shaped portion 16A extends down into the water reservoir of cooler 12. A number of holes 16C are disposed in the bottom of bowl-shaped portion 16A.

A cap puncturing element 18 is supported on the bottom of bowl-shaped portion 16A, with a sharp point 18A that penetrates the center of cap 15 as the inverted bottle 13 is lowered into cap penetrating device 16. Puncturing element 18 includes four grooves 18B that extend from the bottom of penetrating element 18 to the sharp point 18A thereof, permitting water to run down grooves 18B from point 18A into the water reservoir of cooler 12 after the cap 15 has been punctured.

I have constructed and tested a device essentially identical to the above described embodiment of the invention for my own personal use, and it has accomplished the objectives of making it very easy to lift a five gallon water bottle from a shelf or storage stand such as 11, roll hand cart 10 and bottle to water cooler 12, invert the bottle, and lower it onto water cooler 12 with very little physical exertion and with no spillage of water. Hand cart 10 is of simple, inexpensive construction, and I have found that it is very stable, easily maneuverable and safe to use, even while it is supporting bottle 13.

While the invention has been described with reference to several particular embodiments thereof, those skilled in the art will be able to make the various modifications to the described embodiments of the invention without departing from the true spirit and scope of the invention. It is intended that all combinations of elements and steps which perform substantially the same function in substantially the same way to achieve the same result are within the scope of the invention.

What is claimed is:

1. A hand cart adapted to lift an upright water bottle from a support surface of a first height, carry the bottle to a water dispenser of a second height, invert the bottle, and lower a mouth of the bottle into a receiving opening of the dispenser, the hand cart comprising in combination:

(a) a base and a plurality of wheels attached to the base to support and transport the base;

(b) an upright structure supported on the base, and a handle attached to the upright structure to aid pushing/pulling the cart;

(c) a pivot arm structure pivotally connected to an upper portion of the upright structure;

(d) a scissors/jackscrew mechanism pivotally connected between the pivot arm structure and a lower portion of the upright structure to raise and lower an outer portion of the pivot arm structure; and (e) a bottle holding mechanism pivotally connected to the outer portion of the pivot arm structure and adapted to rotate to invert the bottle held by the holding mechanism.

2. The hand cart of claim 1 wherein the first height is approximately 41 inches and the second height is approximately 38.5 inches.

3. The hand cart of claim 2 wherein the bottle contains approximately 5 gallons of drinking water.

4. The hand cart of claim 1 including a handle attached to an end of a jackscrew of the scissors/jackscrew mechanism.

5. The hand cart of claim 4 wherein the scissors/jackscrew mechanism includes a first scissors member pivotally connected at a lower end to the upright structure and pivotally connected at an upper end to a first jackscrew bearing through which the jackscrew extends, a second scissors member pivotally connected at a lower end to the first jackscrew bearing and at an upper end to the pivot arm structure, a third scissors arm pivotally connected at a lower end to the upright structure and at an upper end to a second jackscrew bearing, and a fourth scissors member pivotally connected at a lower end to the second jackscrew bearing and at an upper end to the pivot arm structure.

6. The hand cart of claim 1 wherein the bottle holding mechanism includes first and second bottle engaging pads pivotally connected to spaced first and second outer portions of the pivot arm structure, respectively, and engaging opposite sides of the bottle between circumferential ridges thereof.

7. The hand cart of claim 6 including first and second velcro straps connected to first sides of the first and second bottle engaging pads, respectively, extending partially around a first side of the bottle, and locking together to form a first retaining strap securing the first side of the bottle, and third and fourth velcro straps connected to second sides of the first and second bottle engaging pads, respectively, extending partially around a second side of the bottle, and locking together to form a second retaining strap securing the second side of the bottle.

8. The hand cart of claim 1 wherein the scissors/jackscrew mechanism has a range of operation enabling the upright bottle in the bottle holding mechanism to be raised slightly above the support surface and the inverted bottle to be lowered onto the dispenser.

9. Apparatus for convenient transfer of a large, full water bottle from a support to a water dispensing device, the water bottle having a cap on a dispensing portion thereof, the water dispensing device having therein a receptacle for receiving the dispensing portion of the water bottle, the apparatus comprising in combination:

(a) a hand cart adapted to lift an upright water bottle from a support surface of a first height, carry the bottle to a water dispenser of a second height, invert the bottle, and lower the dispensing portion of the bottle into a receiving opening of the dispensing device, including i. a base and a plurality of wheels attached to the base to support and transport the base, ii. an upright structure supported on the base, and a handle attached to the upright structure to aid pushing/pulling the cart, iii. a pivot arm structure pivotally connected to an upper portion of the upright structure, iv. a scissors/jackscrew mechanism pivotally connected between the pivot arm structure and a lower portion of the upright structure to raise and lower an outer portion of the pivot arm structure, and v. a bottle holding mechanism pivotally connected to the outer portion of the pivot arm structure and adapted to rotate to invert the bottle held by the holding mechanism; and (b) a cap penetrating device disposed in the receptacle and adapted to penetrate the cap as the dispensing portion of the water bottle is lowered into the receptacle.

* * * * *